US005168782A

United States Patent [19]

Cromwell

[11] Patent Number: 5,168,782

[45] Date of Patent: Dec. 8, 1992

[54] TOOL EXTENSION ADAPTER FOR A TOOL DRIVE

[76] Inventor: Robert W. Cromwell, 95 Danbury Rd., New Milford, Conn. 06776

[21] Appl. No.: 678,675

[22] Filed: Apr. 1, 1991

[51] Int. Cl.[5] ..... B25B 23/16

[52] U.S. Cl. ..... 81/177.2; 81/177.85; 81/439

[58] Field of Search ..... 81/177.1, 177.2, 177.85, 81/436, 438, 439

[56] References Cited

U.S. PATENT DOCUMENTS

| | | | |
|---|---|---|---|
| 1,578,065 | 3/1926 | Bemus et al. | 87/177.2 X |
| 1,873,472 | 8/1932 | Pfauser | 81/177.85 X |
| 4,096,896 | 6/1978 | Engel | 81/177.85 X |
| 4,840,094 | 6/1989 | Macor | 81/177.85 X |

FOREIGN PATENT DOCUMENTS

| | | | |
|---|---|---|---|
| 294797 | 2/1954 | Switzerland | 81/DIG. 11 |

*Primary Examiner*—James G. Smith
*Attorney, Agent, or Firm*—Parmelee, Bollinger & Bramblett

[57] ABSTRACT

A tool extension adapter is provided which is adapted to be coupled to a tool drive for permitting the attachment of two different sized tools, for example socket wrenches, to a tool drive such as an air gun or ratchet using the same tool extension adapter merely by reversing the tool extension adapter in the tool drive. The adapter includes a extension bar of different first and second lengths with different first and second predetermined outside dimensions one of which is less than the other to accommodate different sized tools. A plurality of detents are positioned in the extension bar for coupling the reversible extension bar of different end sizes to the tool drive either directly in an impact or with a sleeve coupling to a ratchet tool drive. This permits the use of one tool extension for accommodating two sizes of sockets which prior hereto required two extensions for the different sizes desired.

3 Claims, 3 Drawing Sheets

TOOL EXTENSION ADAPTER FOR A TOOL DRIVE

BACKGROUND OF THE INVENTION

This invention relates to a tool extension adapter which is adapted to be coupled to a tool drive for permitting the attachment of two different sized tools to a tool drive using the same tool extension adapter merely by reversing the tool extension adapter in the tool drive and attaching the desired tool size to the uncoupled end of the tool extension adapter.

When using a power tool drive such as an impact or even a hand-operated ratchet, in order to use different sockets thereon different sizes must be utilized. In other words, when a ½ inch socket is desired to be replaced with a ⅜ inch socket, the ½ inch socket must be removed from the drive and a ⅜ inch socket must be attached thereto. When the tool drive requires an extension in order to reach a particular location, for example, in servicing an automobile engine or similar mechanical structures which have remote and difficult locations to reach, the provision of multiple extensions to accommodate different sizes of socket is not only expensive but time-consuming. In the first place, individual extensions must be utilized and attached before the proper sized socket may be mounted thereon. This is because each extension accommodates the holding or retention of a single socket size.

It would be much more convenient and economical if a single extension could accommodate more than one size socket thereon in a manner which is practical, cost effective, and simple to use and operate in a non-time-consuming manner.

SUMMARY OF THE INVENTION

Accordingly, it is an object of this invention to provide a new and improved tool extension adapter which will accommodate more than one size tool on a single bar removing the requirement of providing separate extension bars for each sized tool which is desired to be coupled to a tool drive.

Still another object of this invention is to provide a new and improved extension adapter which is simple in construction, easy to operate and cost-effective.

In carrying out this invention in one illustrative embodiment thereof, a tool extension adapter is provided which is adapted to be coupled to a tool drive for permitting the attachment of two different sized tools to a tool drive using the same tool extension adapter merely by reversing the tool extension adapter in the tool drive. The tool extension adapter has a extension bar with a first length of a first predetermined outside dimension and a second length of a second predetermined outside dimension which is less than the first predetermined outside dimension of the first length. The first and second lengths generally have similar outside dimensions of different sizes. A plurality of detent means are positioned in the extension bar, one of said plurality of detent means being positioned in the first length and more than one of said plurality of detent means being positioned in the second length. The extension bar has first and second ends with the first end being on the first length and the second end being on the second length whereby different sized tools may be used on the first and second ends of the extension bar merely by reversing the end of the extension bar which is coupled to the tool drive and positioning a tool desired to be used on the other end of the extension bar.

The tool extension adapter may be used directly on a tool drive ratchet or on an impact which is modified to receive and retain either end of the extension bar.

BRIEF DESCRIPTION OF THE DRAWINGS

The invention, together with further objects, features, aspects and advantages thereof, will be more clearly understood from the following drawings in which like numerals will be used to identify like elements throughout the various views.

DESCRIPTION OF THE PREFERRED EMBODIMENTS

Figure 1:
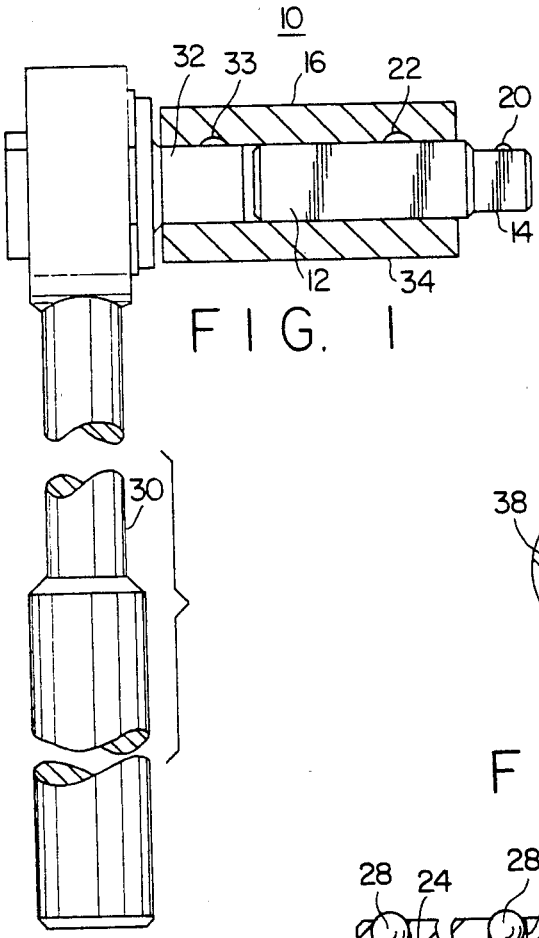
FIG. 1 is a side elevational view of a tool drive ratchet partly broken away and a tool extension adapter showing the sleeve mounting for such extension in cross section.

Referring now to FIGS. 1–6, a tool extension adapter, referred to generally with the reference character 10, includes an extension bar 12 with a first length 14 and a second length 16. The bar 12 is provided with machined edges 18 in order to facilitate the mounting of the bar 12 in either cooperating structure or tool drives as well as mounting socket on the bar extension 12 as will be described hereinafter.

Figure 6:
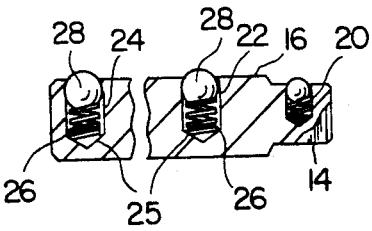
FIG. 6 is a cross sectional view taken along lines 6—6 of FIG. 5.
Figure 5:
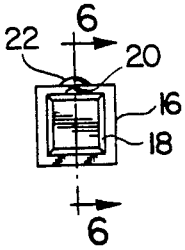
FIG. 5 is an end view of the extension bar as illustrated in FIG. 1.

As will best be seen in FIG. 6, a plurality of detent means 20, 22 and 24 are positioned in the bar 12 with one of the detent means being positioned in the first length 14 and detent means 22 and 24 are spaced near the ends of second length 16. Each of the detent means 20, 22 and 24 is mounted in a well 25 in the extension bar 12 each of which includes a spring 26 and a ball 28.

Figure 4:
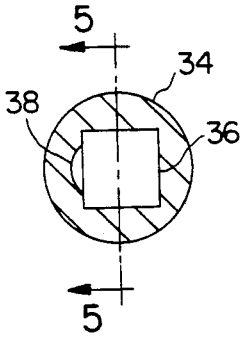
FIG. 4 is a cross sectional view taken along lines 4—4 of FIG. 3 with the cross sectional view along lines 5—5 of FIG. 4 being the one which is shown in FIGS. 1 and 2.
Figure 3:
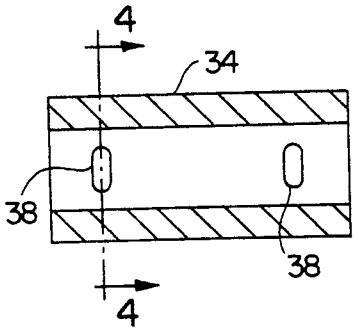
FIG. 3 is a cross sectional view of the sleeve of the embodiment shown in FIGS. 1 and 2.

For certain applications, for example where the tool drive contains an arbor (not shown) or where the tool drive is a ratchet 30 as shown in FIG. 1 with a drive post 32 thereon housing a detent 33, a sleeve 34 is used with the extension bar 12 for coupling the extension bar 12 to the ratchet 30 to be driven thereby. The sleeve 34 has a polygonal channel 36 therein as shown in FIG. 4 which is preferably square as shown. As will be seen in FIG. 3, the sleeve 34 contains spaced grooves 38 thereon which are adapted to receive retain detent means 22 and detent 33 of drive post 32 therein.

It should be noted that the first length 14 of the extension bar 12 has a smaller predetermined outside dimension than the predetermined outside dimension of the second length 16. For example, the second length 16 of the extension bar 12 may have a dimension which is suitable for accommodating ½ inch ratchets 30 or impacts, and the shorter first length 14 may be dimensioned to accommodate the attachment of ⅜ inch standard sized socket thereto. Obviously, other sizes could be utilized for the first and second lengths 14 and 16 of the extension bar 12 in order to accommodate different standard and metric sized sockets as desired. The ⅜ and ½ inch are referred to because of their common usage.

In usage, the extension bar 12 is inserted in the sleeve 34 when the tool extension adapter 10 is desired to be mounted and driven by the ratchet 30. As shown in FIG. 1, the extension bar is positioned in the sleeve 34 with the detent 22 positioned in the groove 38 so that the extension bar is retained in the sleeve 34 when mounted therein.

The first length 14 with its detent means 20 protrudes from the end of the sleeve and is adapted to accommodate the mounting of, for example, a ⅜ inch socket wrench thereon (not shown). The entire tool extension adapter 10 is positioned on the arbor or drive post 32 of the ratchet 30 with, for example, the sleeve having a ½ inch polygonal channel therein to accommodate the larger outer dimension of second length 16 of the extension bar 12. In other words, the tool extension adapter 10 (as shown in FIG. 1) converts a ½ inch to a ⅜ inch extension drive. It will be apparent that the tool extension adapter 10 may be of a different size length depending on the needs or desires of the user. There is, of course, a limit to the length of the tool extension adapter which to some extent will depend on the type of tool drive.

Figure 2:
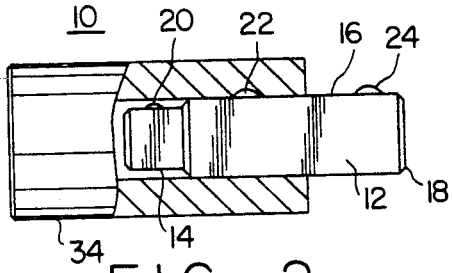
FIG. 2 shows the tool extension adapter of this invention similar to FIG. 1 with the extension bar reversed in its sleeve from the showing of FIG. 1 and the sleeve being in partial cross section.

In FIG. 2, in order to convert the tool extension adapter 10 from a smaller to a larger size, for example ⅜ inch to ½ inch, all that is necessary is to simply remove the extension bar 12 (as shown in FIG. 1) and reverse the extension bar 12 and reinsert it in the sleeve 34 as shown in FIG. 2. As will be seen, the first length 14 is housed within the polygonal channel 36 while the detent means 22 contacts one of the grooves 38 in the sleeve 34 while the other detent means 24 is exposed for the coupling of sockets thereto. Although generally square configurations are desired for the shape of extension bar 12 and the channel 36, other polygonal shapes may be utilized.

The embodiment shown in FIGS. 7–12 is similar to the embodiment shown in FIGS. 1–6 for those applications requiring the sleeve 34. In this embodiment, the detent means 22, as is most clearly shown in FIG. 6, is replaced by a slot 40 in the second length 16 of the extension bar 12 along with a cooperating set screw 42 which is mounted in the sleeve 34. The slot 40 may be positioned on any of the flat surfaces of the extension bar 12.

Figure 8:
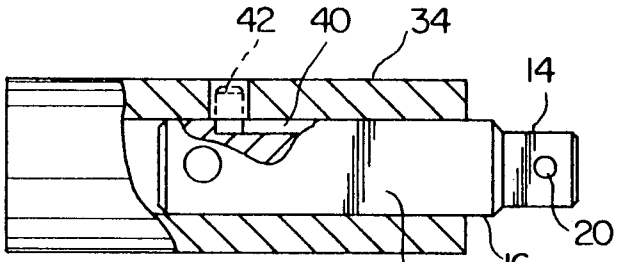
FIG. 8 is a view similar to FIG. 7 showing the extension bar reversed in its accompanying sleeve.
Figure 7:
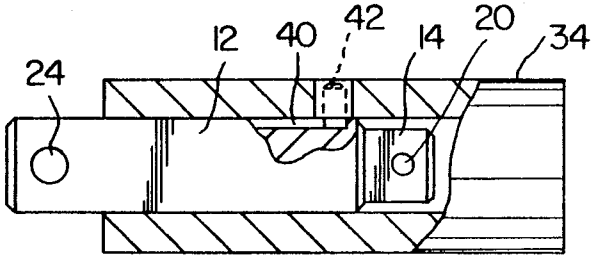
FIG. 7 shows another embodiment of the tool extension adapter with the sleeve and extension bar partly in section.
Figure 9:
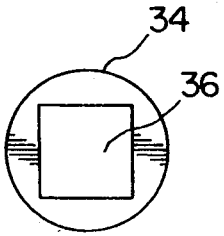
FIG. 9 is an end view of the sleeve as illustrated in FIGS. 7 and 8.
Figure 10:
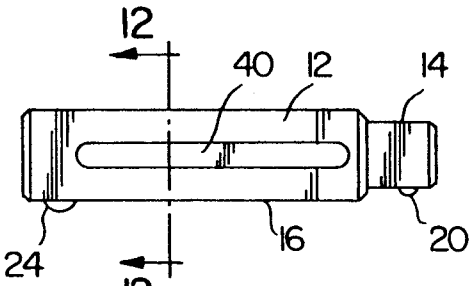
FIG. 10 is a top view of the bar extension of the embodiment of FIG. 7.
Figure 11:
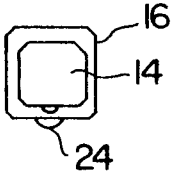
FIG. 11 is an end plan view of FIG. 10.
Figure 12:
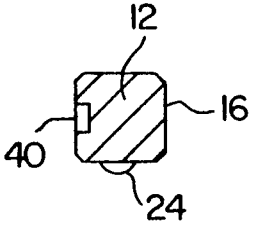
FIG. 12 is a cross sectional view taken along lines 12—12 of FIG. 10.
Figure 14:
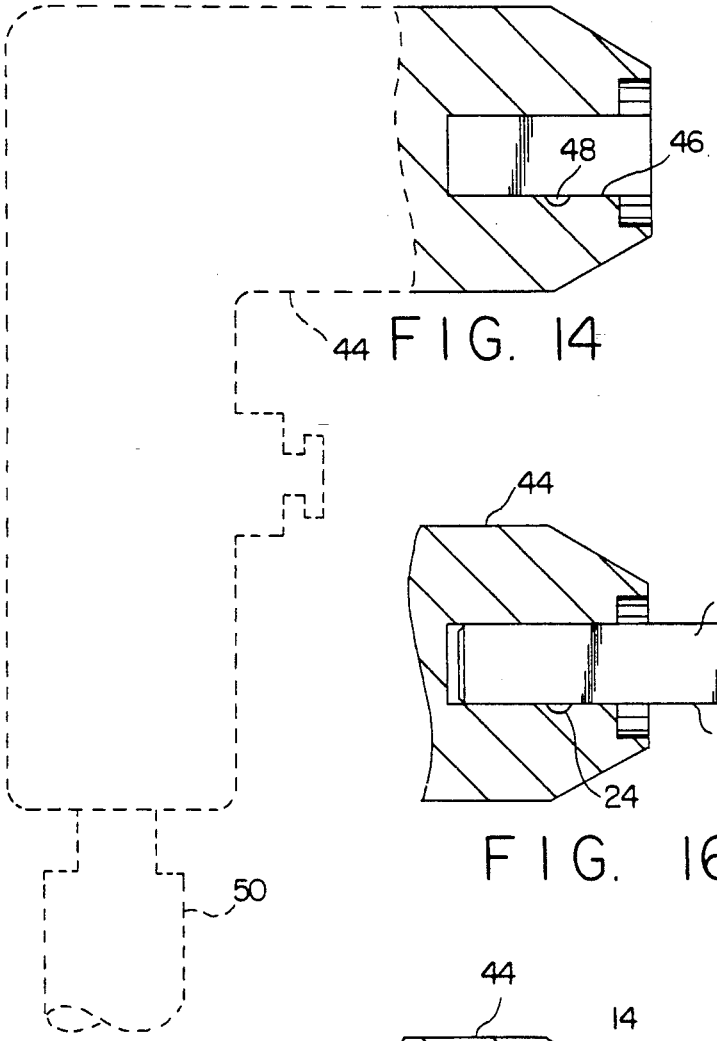
FIG. 14 illustrates a side elevational view of a tool drive in the form of an impact partly in phantom with the drive socket of the impact in section.
Figure 15:
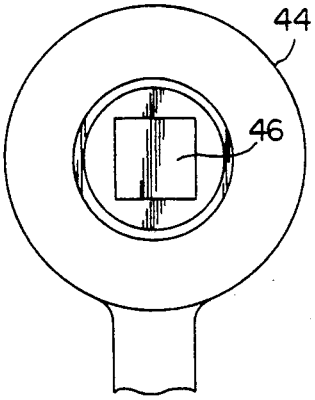
FIG. 15 is a partial end view of the tool drive illustrated in FIG. 14.

The only requirement is that when the extension bar 12 is inserted in the sleeve 24, that the set screw 42 can extend into slot 40 to prevent the extension bar 12 from leaving the sleeve 34. As will be seen in FIG. 7 which corresponds to the position of the extension bar 12 in the sleeve 34 (as shown in FIG. 2 of the earlier embodiment), the extension bar 12 is inserted in the channel 36 of the sleeve 34 and locked therein by the set screw 42 being screwed down into the slot 40 of the extension bar 12. As will be seen in FIG. 7, the larger polygonal dimension of the second length 16 is exposed permitting the mounting of a socket on the detent means 24. At the same time, it will be seen that the first length 14 with its accompanying detent means 20 is completely housed in the channel 36. In order to change sizes, all that is necessary is to remove the extension bar 12 from the sleeve 34 and reverse the position shown in FIG. 7 for the bar as illustrated in FIG. 8 which exposes the smaller dimension of the first length 14 for the attachment of a socket to be held thereon by the detent means 20. In this embodiment, a sleeve 34 is essential because the detent means includes the set screw 42 which of necessity must be mounted in the sleeve 34 to cooperate with the slot 40 in the extension bar 12.

Figure 16:
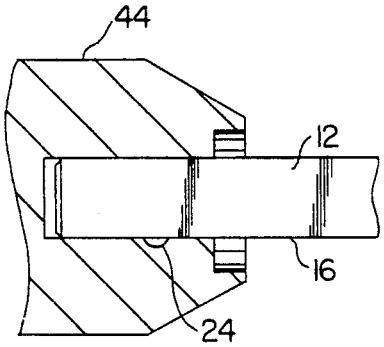
FIG. 16 is side elevational view partly in section showing the extension bar of FIG. 13 mounted in the socket of the impact on one end thereof.
Figure 17:
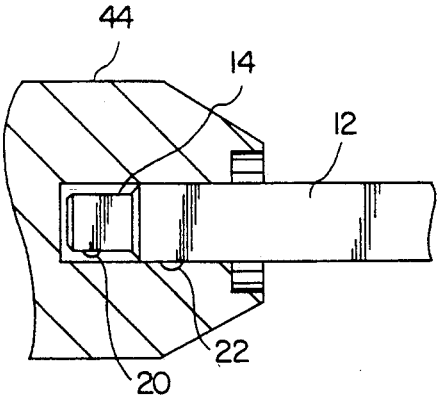
FIG. 17 is similar to FIG. 16 showing the extension bar of FIG. 13 reversed in the impact socket from the showing in FIG. 16.
Figure 13:
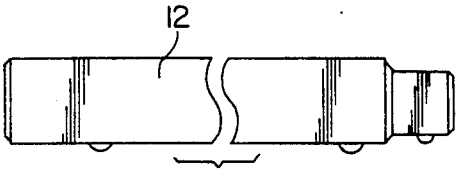
FIG. 13 is a side elevational view of the extension bar of the type illustrated in the embodiment of FIGS. 1–6.

The embodiments of FIGS. 1–6 and 7–12 require a drive means which has some form of protruding arbor on which the sleeve 34 carrying the extension bar may be positioned. In the embodiment as illustrated in FIGS. 13–17, the air gun or impact 44 is modified simply to provide a coupling channel 46 with a detent groove 48 therein for the receipt and the retention of the extension bar 12 as illustrated in FIG. 13 which is the same as that shown in FIG. 6. The operation, of course, is the same as the other embodiments which as shown in FIG. 16 has the second length 16 inserted in coupling channel 46 which has the same configuration as the outer dimension or shape of the second length 16 which is preferably square. Detent means 24 of the extension bar 12 engages the coupling channel 46 in the air gun or impact 44 to lock the extension bar 12 in the impact for rotation therein by the application of a pressurized air supply 50. By positioning the second length 16 in the impact 44 (as shown in FIG. 16), the first length 14 of smaller dimension than the second length 16 is exposed for mounting socket wrenches thereon. When it is desired to convert the tool extension adapter to a larger size, the extension bar 12 is removed, reversed and inserted in the coupling channel 46 with the detent 22 engaging the detent groove 48 in a manner shown in FIG. 17. This exposes the outer dimension of the second length 16 and its accompanying detent 24 for engagement with a socket which is adapted to be placed thereon. If the impact 44 is not modified and provides a protruding arbor, than the embodiments illustrated in FIGS. 1 and 7 may be utilized with the sleeve being positioned on such an arbor.

Accordingly, a single tool extension adapter is provided which will accommodate two different sizes of tools for attachment to either end thereof. In normal practice, such an extension has only one coupling and multiple extensions are necessary, one for each size which is desired to be used. The tool extension adapters may have varying lengths to accommodate reaching remote areas where, for example, the impact 44 or the ratchet 30 may either not reach or sufficient space is not available. By using the reversible tool extension adapter, a simple in and out process by slideable internal movement easily adapts the extension bar for two size operation. All that is necessary is to grasp the extension bar, pull it out of either the sleeve or the impact tool, reverse it by 180° and insert it back in and the entire process takes very little time and effort.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

I claim:

1. A tool extension adapter adapted to be coupled to a tool drive for permitting the attachment of two different sized tools to a tool drive using the same tool extension adapter merely by reversing the tool extension adapter in the tool drive comprises:

an extension bar having a first length of a first predetermined outside dimension and a second length of a second predetermined outside dimension which is less than said first predetermined outside dimension of said first length, said first and second length having outside dimensions of different sizes;

a plurality of detent means positioned in said extension bar, one of said plurality of detent means being positioned in said second length and more than one of said plurality of detent means being positioned in said first length;

first and second ends on said extension bar with said first end being on said first length and said second end being on said second length whereby different sized tools can be used on said first and second ends of said extension bar merely by reversing the end of said extension bar which is coupled to said tool drive and positioning a tool which fits on the other end of said extension bar; and a sleeve adapted to be coupled to a tool drive, a channel through said sleeve for slideably receiving said extension bar, a pair of spaced grooves in said channel adapted to receive one of said detent means in said second length of said extension bar for holding said extension bar in said sleeve and exposing one of said detent means from said sleeve on which a tool can be mounted.

2. The tool extension as claimed in claim 1 wherein said plurality of detent means each include a ball means positioned on a spring in well in said extension bar.

3. The tool extension as claimed in claim 1 wherein one said detent means includes a slot in said first length cooperating with a set screw mounted in said sleeve for fixedly positioning said extension bar in said sleeve when either the first or second length is first inserted into said sleeve and said set screw is tightened into said slot for preventing the extension bar from leaving the sleeve.

* * * * *